US007668491B2

(12) United States Patent
Furuya et al.

(10) Patent No.: US 7,668,491 B2
(45) Date of Patent: Feb. 23, 2010

(54) BELT CONVEYOR AND IMAGE FORMING APPARATUS TO DETECT AND CORRECT MEANDERING OF A BELT

(75) Inventors: Nobuyuki Furuya, Ibaraki (JP); Yoshihiko Sano, Ibaraki (JP)

(73) Assignee: Ricoh Company Ltd., Tokyo (JP)

( * ) Notice: Subject to any disclaimer, the term of this patent is extended or adjusted under 35 U.S.C. 154(b) by 258 days.

(21) Appl. No.: 11/449,840

(22) Filed: Jun. 9, 2006

(65) Prior Publication Data

US 2006/0289280 A1 Dec. 28, 2006

(30) Foreign Application Priority Data

Jun. 10, 2005 (JP) ..... P2005-170583

(51) Int. Cl.
*G03G 15/16* (2006.01)

(52) U.S. Cl. ..... 399/302; 399/308

(58) Field of Classification Search ..... 399/302, 399/308, 312, 313
See application file for complete search history.

(56) References Cited

U.S. PATENT DOCUMENTS 5,784,676 A 7/1998 Iseki et al.
7,354,128 B2 * 4/2008 Koike ..... 347/19
2004/0096236 A1 * 5/2004 Shin ..... 399/88
2006/0077220 A1 * 4/2006 Nakayama ..... 347/19

FOREIGN PATENT DOCUMENTS

| | | |
|---|---|---|
| JP | 6-9096 | 1/1994 |
| JP | 09-048533 | 2/1997 |
| JP | 10139202 A * | 5/1998 |
| JP | 11-249453 | 9/1999 |
| JP | 2000-34031 | 2/2000 |
| JP | 2001-083840 | 3/2001 |
| JP | 2001-130779 | 5/2001 |
| JP | 2004-219866 | 8/2004 |
| JP | 2005-084209 | 3/2005 |

* cited by examiner

*Primary Examiner*—Quana M Grainger
(74) *Attorney, Agent, or Firm*—McGinn IP Law Group, PLLC

(57) ABSTRACT

A belt conveyor includes: an endless belt that is looped over a plurality of rollers, the plurality of rollers including a drive roller and a meandering correction roller; a drive unit that rotates the drive roller to drive the endless belt; a meandering correction unit that adjusts an inclination of the meandering correction roller to correct meandering of the endless belt in a width direction thereof; a plurality of position detection units that detect positions of the endless belt in the width direction thereof and output detection signals; and a meandering correction control unit that selectively uses the detection signals from the plurality of detection units to control the meandering correction unit.

25 Claims, 11 Drawing Sheets

BELT CONVEYOR AND IMAGE FORMING APPARATUS TO DETECT AND CORRECT MEANDERING OF A BELT

BACKGROUND OF THE INVENTION

1. Field of the Invention

The present invention relates to image forming apparatus, such as a printer, a copier, and the like, particularly to a belt conveyor having the function of correcting meandering of endless belts, such as an intermediate transfer belt, a sheet transfer belt, and the like, and an image forming apparatus using the belt conveyor.

2. Description of the Related Art

In relation to a multicolor image forming apparatus, such as a full-color printer or a spot-color printer, a tandem-type multicolor image forming apparatus is available. In this system, a plurality of photosensitive drums are arranged along a conveying direction of an intermediate transfer belt, which is an endless belt, and toner of different colors is caused to adhere to electrostatic latent images formed on the respective photosensitive drums, to thus form toner images and sequentially transfer the toner images on the transfer belt.

This type of the apparatus inevitably encounters a phenomenon of an intermediate transfer belt, which is an endless belt, moving in a width direction thereof in association with driving of the intermediate transfer belt, i.e., a meandering phenomenon of the belt. This meandering phenomenon causes positional offsets of color images and, by extension, color misregistration, when the images of respective colors are transferred onto the intermediate transfer belt in a superposing manner. Therefore, the meandering phenomenon must be corrected.

There are several methods for correcting meandering of the transfer belt. One of them is a method for taking one of rollers supporting a transfer belt as a meandering correction roller and controlling the inclination of the meandering correction roller.

FIGS. 14A to 14C are descriptive views illustrating the control method. When one side edge of a correction roller 20 is raised from a state shown in FIG. 14A to a state shown in FIG. 14B, the transfer belt shifts toward the side edge of the raised side of the roller. In contrast, when one side edge of the correction roller 20 is lowered as shown in FIG. 14C, the transfer belt shifts in a direction opposite to the lowered side of the correction roller. Accordingly, the amount of shift of the transfer belt can be controlled by means of varying the inclination of one side of the correction roller 20 with respect to the other side.

One technical problem encountered by the method for controlling the inclination of the meandering correction roller is a method for detecting the amount of meandering of the transfer belt over a wide range and with a high degree of accuracy. Another problem is to detect an anomaly when the amount of meandering has exceeded a certain range, to thus prevent occurrence of breakage of the belt without fail. The respective technical problems will be described hereunder.

A system disclosed in, e.g., JP-A-2000-034031, has been known as a method for detecting movement of an endless transfer belt in the width direction thereof, i.e., meandering.

As shown in FIG. 15, this method is achieved by means of placing a contact 52 at the side edge of the transfer belt 51; supporting the contact 52 so as to be rotatable around a support shaft 53; causing one member 52*a* of the contract 52 to keep contact with the transfer belt 51 at all times by means of tensile force of a spring 54; and arranging a displacement sensor 55 in close proximity to another member 52*b*. The displacement sensor 55 includes, e.g., alight-emitting section and a light-receiving section. The light emitted from the light-emitting section is reflected from an object of measurement, to thus detect a distance between the object of measurement and the displacement sensor 55 from the position of reflected light received by the light-receiving section and displacement of the reference position.

According to such a configuration, when the transfer belt 51 has caused meandering, the contact 52 rotates around the support shaft 53 in association with the meandering, whereby the distance between the member 52*b* and the displacement sensor 55 is displaced. Accordingly, the amount of displacement is detected by the displacement sensor 55, so that the amount of displacement of the transfer belt 51 in the width direction can be detected.

The amounts of meandering that can be detected by the system; that is, the amount of displacement of the transfer belt 51 in the width direction, is determined by a distance Y2 between the support shaft 53 and the transfer belt 51 and a distance Y1 between the support shaft 53 and a point of measurement of the displacement sensor 55

Provided that a detection range of the displacement sensor 55 is taken as 10 mm, in the case of Y1=Y2, the amount of detectable displacement of the transfer belt 51 in the width direction assumes 10 mm. In this case, the detection accuracy of the amount of displacement of the transfer belt 51 becomes equal to that of the displacement sensor 55, because Y1 and Y2 assume a proportion of 1:1.

In order to increase the amount of detectable displacement of the transfer belt 51, the proportion between Y1 and Y2 (Y1/Y2) is assumed to be ½, the amount of detectable displacement of the transfer belt 51 comes to 20 mm. In contrast, the detection accuracy of the position of the edge of the transfer belt 51 becomes half the accuracy of detection of the displacement sensor 55.

Accordingly, when the displacement sensor 55 is used for detecting the position of the edge of the belt 51, the distances Y2 and Y1 are appropriately selected such that the range of displacement of the belt 51 in the width direction falls within the detectable range of the displacement sensor 55. For instance, when the range of displacement of the belt 51 is of the order of 5 mm, the detection range of the displacement sensor 55 is usually 2 mm or thereabout. Hence, the range of displacement of the belt 51 is caused to fall within the detection range of the displacement sensor 55 by means of making the distance Y1 be greater than the distance Y2.

However, in order to lessen positional displacements of the toner images of respective colors in an image forming apparatus, the amount of displacement (meandering) of the belt 51 in the width direction must be detected with high accuracy, to thus correct the meandering of the belt 51. For this reason, the proportion between Y1 and Y2 is desirably made close to or equal to 1:1. However, according to the above method, the range where movement of the transfer belt can be detected and the detection accuracies are contrary to each other. Hence, difficulty is countered in detecting the displacement over a wide range and with a high degree of accuracy.

The second technical problem is to detect anomalies in meandering of the transfer belt. When the anomalies, such as meandering of the transfer belt exceeding the detectable range of a displacement sensor arises, driving of the belt must be stopped, to thus prevent occurrence of fracture of the belt.

JP-A-Hei. 6-9096, U.S. Pat. No. 5,784,676 and JP-A-2001-130779 provide several proposed methods for addressing anomalies when the meandering of the transfer belt increases. In general, when the displacement sensor detects an anomaly, a signal is input to a microprocessor. The microprocessor controls a drive roller of the transfer belt so as to stop the drive roller. However, in order to reliably prevent occurrence of an accident, such as fracture of a belt, realization of a highly-reliable anomaly detection system has been desired.

SUMMARY OF THE INVENTION

The present invention has been made in view of the above circumstances and provides a belt conveyor and an image forming apparatus using the belt conveyor.

According to an embodiment of the invention, the belt conveyor and the image forming apparatus are capable of detecting an amount of displacement of an endless belt in the width direction with high accuracy and over a wide range and correcting meandering.

According to another embodiment of the invention, the belt conveyor and the image forming apparatus are capable of stopping driving of a belt when the amount of displacement of the endless belt exceeds a predetermined range and this is ascertained as an anomaly, to thus reliably prevent fracture of the belt.

According to an aspect of the invention, there is provided a belt conveyor including: an endless belt that is looped over a plurality of rollers, the plurality of rollers including a drive roller and a meandering correction roller; a drive unit that rotates the drive roller to drive the endless belt; a meandering correction unit that adjusts an inclination of the meandering correction roller to correct meandering of the endless belt in a width direction thereof; a plurality of position detection units that detect positions of the endless belt in the width direction thereof and output detection signals; and a meandering correction control unit that selectively uses the detection signals from the plurality of detection units to control the meandering correction unit.

In addition, the plurality of detection unit may include first and second position detection units that continuously detect the positions of the endless belt in the width direction and have equal detection ranges. The first and second position detection units may be placed at different positions with respect to the width direction of the endless belt from each other. The meandering correction control unit may selectively use the detection signal from one of the first and second position detection units to control the meandering correction unit.

In addition, each of the first and second position detection units may include: a displacement member that displaces in response to displacement of the endless belt in the width direction thereof; and a sensor that converts an amount of the displacement of the displacement member into an electrical signal. The amount of the displacement of the displacement member included in the first position detection unit, and the amount of the displacement of the displacement member included in the second positional detection unit are different from each other.

In addition the position detection unit may include first and second position detection units that continuously detect the position of the endless belt in the width direction thereof and have different detection ranges from each other. And the meandering correction control unit may selectively use detection signals from one of the first and second position detection units to control the meandering correction unit.

In addition, the first and second position detection units may have different position detection accuracy from each other.

In addition, the belt conveyor may further include control unit that stops a rotation of the drive roller when the detection signal from one of the first and second position detection unit falls outside a predetermined range.

In addition, the position detection unit may include: a first position detection unit that continuously detects the position of the endless belt in the width direction thereof; and a third position detection unit that detects presence/absence of the endless belt.

In addition, the belt conveyor may further include a control unit that stops the rotation of the drive roller when the third position detection unit detects presence of the endless belt.

According to the above configuration, the position of the endless belt in the width direction can be detected over a wide range with high accuracy, and meandering of the endless belt is corrected in accordance with the detection signal, and hence an image forming apparatus which produces a high-quality, high image-quality image can be provided.

When the amount of displacement of the endless belt exceeds the predetermined range and an anomaly arises, there is also yielded an effect of the belt conveyor being capable of reliably detecting the anomaly and stopping the driving of the endless belt, to thus prevent fracture of the belt.

DETAILED DESCRIPTION OF THE INVENTION

First, an image forming apparatus using a belt conveyor according to embodiments of the present invention will be described hereinbelow. Next, first to third embodiments of the belt conveyor of the present invention will be sequentially described.

Four-Color (Full-Color) Image Forming Apparatus

Figure 2:
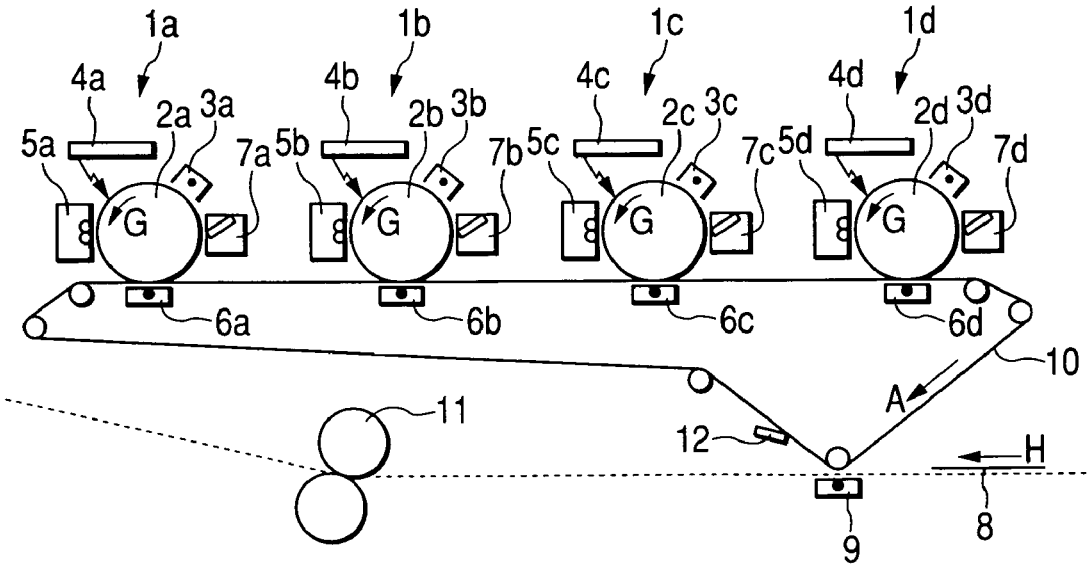
FIG. 2 is a diagrammatic view of an image forming apparatus according to embodiments of the present invention.

FIG. 2 is a diagrammatic view of a four-color (full-color) image forming apparatus according to the embodiments of the present invention. The image forming apparatus has four image-forming units 1*a*, 1*b*, 1*c*, and 1*d* arranged along the conveying direction of a transfer belt 10.

The image-forming unit 1*a* includes a photosensitive drum 2*a*, a drum electrifying device 3*a*, an exposure device 4*a*, a development machine 5*a*, a transfer unit 6*a*, and a cleaner 7*a*. The image-forming units 1*b* to 1*d* are also configured analogously.

For example, the image-forming unit 1*a* forms a yellow color image; the image-forming unit 1*b* forms a magenta color image; the image-forming unit 1*c* forms a cyan color image; and the image-forming unit 1*d* forms a black color image.

Upon receipt of a command signal for starting image forming operation from a controller (not shown), the photosensitive drum 2*a* starts rotating in the direction of arrow G and continues rotating until the image-forming operation is completed. When the photosensitive drum 2*a* starts rotation, a high voltage is applied to the electrifying device 3*a*, and the surface of the photosensitive drum 2*a* is uniformly electrified with negative electric charges.

When character data or graphic data, which have been converted into a dot image, are sent from the controller (not shown) to the image forming apparatus as an activation/deactivation signal for the exposure device 4*a*, areas exposed to a laser beam from the exposure device 4*a* and area not exposed to the laser are formed on the surface of the photosensitive drum 2*a*. The area on the photosensitive drum 2*a*, whose electric charges have dropped upon exposure to the laser beam emitted from the exposure device 4*a*, come to the position opposing the development machine 5*a*, and the negatively-charged toner adheres to the area on the photosensitive drum 2*a* whose electric charges have dropped, to thus form a toner image.

When the toner image formed on the photosensitive drum 2*a* comes to the transfer device 6*a*, the toner image is transferred onto a transfer belt 10 which is rotating in the direction of arrow A by means of action of high voltage applied to the transfer unit 6*a*. The photosensitive drum 2*a* passing through the transfer position is cleaned by the cleaner 7*a* to thus eliminate the toner still remaining on the surface of the photosensitive drum 2*a*, thereby preparing for the next image-forming operation.

Subsequent to the image-forming unit 1*a*, the image-forming unit 1*b* performs the image forming operation as well. Thus, the toner image formed on the photosensitive drum 2*b* is transferred onto the transfer belt 10 by means of action of high voltage applied to the transfer unit 6*b*. At this time, the timing when the image, which has been formed by the image-forming unit 1*a* and transferred onto the transfer belt 10, reaches the transfer unit 6*b* is synchronized with the timing when the toner image formed on the photosensitive drum 2*b* is transferred to the transfer belt 10, whereby the toner image formed by the image-forming unit 1*a* and the toner image formed by the image-forming unit 1*b* overlap on the transfer belt 10. Similarly, the toner images formed on the image-forming units 1*c*, 1*d* are overlapped on the transfer belt 10, to thus form a full-color image on the transfer belt 10.

Concurrently with the full-color image reaching a sheet transfer unit 9, a sheet 8 transported, in the direction of arrow H, from a sheet-feeding section (not shown) of the image forming apparatus also reaches the sheet transfer unit 9, and the full-color image on the transfer belt 10 is transferred to the sheet 8 by means of action of high voltage applied to the sheet transfer unit 9. When the sheet 8 is transported to a fixing device 11, the toner image on the sheet 8 is fused and fixed to the sheet 8.

After the full-color image passes through the sheet transfer unit 9, untransferred toner still adheres to the transfer belt 10, and the toner is cleaned by a belt-cleaning mechanism 12.

The present invention relates to a belt conveyor used in the above-described image forming apparatus, and embodiments of the present invention will be described hereunder.

First Embodiment

Belt Conveyor

Figure 3:
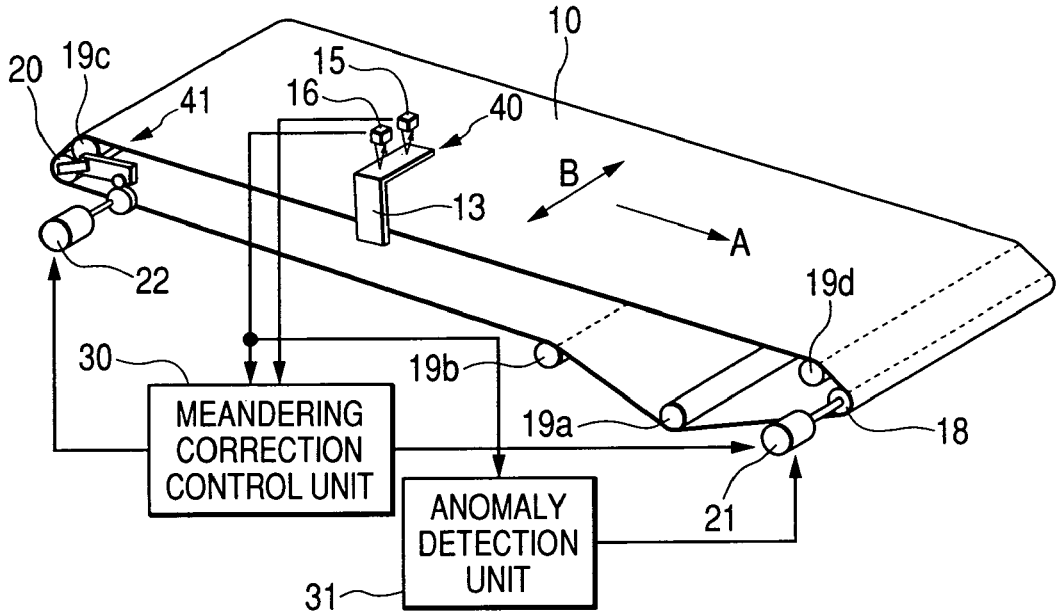
FIG. 3 is a diagrammatic view showing the belt conveyor according to the first embodiment of the present invention.

FIG. 3 is a diagrammatic view of a configuration of a belt conveyor according to a first embodiment of the invention used for driving the endless transfer belt 10. As shown in FIG. 3, the belt conveyor of the present embodiment includes the endless transfer belt 10, a belt position detection mechanism 40, a belt meandering correction mechanism 41, a meandering correction control section 30, an anomaly detection section 31, and the like. The transfer belt 10, which is an endless belt, is looped over a drive roller 18, a meandering correction roller 20, and driven rollers 19*a* to 19*d*. The drive roller 18 is coupled to a belt drive motor 21. When the motor 21 is rotated, the belt 10 moves. In the following descriptions, the direction of arrow A in FIG. 3 is called a belt conveying direction, and the direction of arrow B is called a belt width direction.

The belt position detection mechanism 40 detects the position of the edge of the transfer belt 10, whereby the amount of meandering of the transfer belt 10 in the width direction thereof is determined. The belt position detection mechanism 40 includes a contact 13 which contacts the side edge of the belt, a displacement sensor 15 constituting a first belt position detection unit, and a displacement sensor 16 constituting a second belt position detection unit. Detection signals output from the respective displacement sensors 15, 16 are input to the meandering correction control section 30, and a signal from a displacement sensor 16 is input to the anomaly detection section 31.

In the meantime, the belt meandering correction mechanism 41 performs control operation to thus correct meandering of the transfer belt 10 by means of changing the inclination of the meandering correction roller 20. The amount of inclination of the meandering correction roller 20 is controlled by the quantity of rotational movement of a meandering correction motor 22, and the amount of rotational movement of the motor 22 is controlled by the meandering correction motor drive section 30.

The meandering correction control section 30 sends to the meandering correction motor 22 a signal for instructing correction of the meandering. Further, the meandering correction control section 30 and the anomaly detection section 31 send to the belt drive motor 21 a signal for controlling the driving of the belt.

Belt Meandering Correction Mechanism 41

Figure 4:
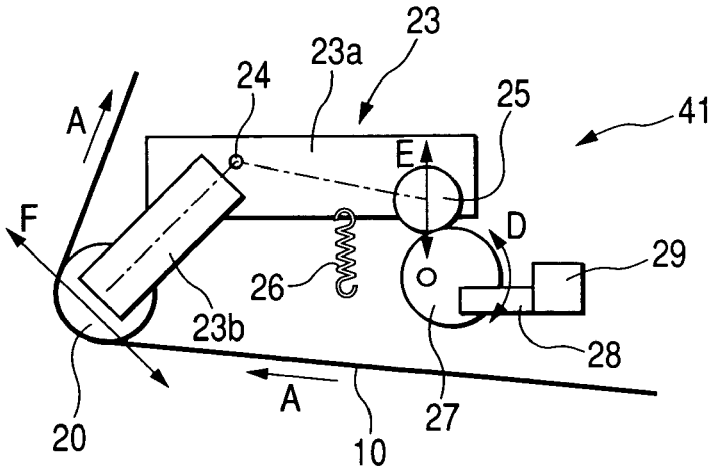
FIG. 4 is a diagrammatic view of a meandering correction mechanism in the belt conveyor according to the embodiments of the present invention.

A specific example of the belt meandering correction mechanism 41 will be described with reference to FIG. 4. The belt meandering correction mechanism 41 includes a rotatable arm 23, an eccentric cam 27, an eccentric cam position detection sensor 29, and the like.

The rotational arm 23 includes two members 23*a*, 23*b*. The end of the member 23*b* is connected to the end of the meandering correction roller 20, and a bearing 25 is fastened to the end of the other member 23*a*. The members 23*a*, 23*b* are supported so as to be able to integrally rotate around a rotary shaft 24.

A spring 26 is attached to the member 23*a* of the rotational arm 23. The bearing 25 keeps in contact with the eccentric cam 27 at all times by means of tensile force of the spring 26. The eccentric cam 27 rotates around the rotary shaft, which is provided in an eccentric position, in the direction of arrow D. The rotary shaft of the eccentric cam 27 is connected to the rotary shaft of the meandering correction motor 22 shown in FIG. 3.

An eccentric cam position detection sensor 29 is provided in close to the eccentric cam 27. The reference position of the eccentric cam 27 can be ascertained by means of detecting the position of a shielding plate 28 provided on the eccentric cam 27.

Since the configuration of the eccentric cam position detection sensor 29 is known, its detailed description is omitted. As described in, e.g., Patent Document 1, the eccentric cam position detection sensor can include a photo-interrupter having a light-emitting element and a light-receiving element provided in close proximity to each other, and a slit plate placed at a position where it blocks an optical axis of the photo-interrupter.

Operation of the belt meandering correction mechanism 41 will now be described. The amount of rotation of the meandering correction motor 22 is instructed by the meandering correction control section 30 shown in FIG. 3. When the motor 22 has rotated through a predetermined angle, the eccentric cam 27 is also rotated in the direction of arrow D in association with rotation of the motor 22. Hence, the bearing 25 is vertically actuated in the direction of arrow E.

When the bearing 25 has moved upward, one end of the member 23*a* rotates upward around the shaft 24. Conversely, the end of the member 23*b* rotates downward around the shaft 24. The end of the member 23*b* is connected to the meandering correction roller 20. Therefore, when the end of the member 23*b* rotates downward, the correction roller 20 also moves downward in the direction of arrow F. Conversely, when the bearing 25 moves downward, the meandering correction roller 20 moves upward in the direction of arrow F.

As shown in FIG. 3, one end of the meandering correction roller 20 is fixed, and the end of the meandering correction roller connected to the rotational arm 23 is vertically actuated. Hence, the meandering correction roller 20 is inclined in accordance with the amount of rotation of the motor 22. When the meandering correction roller 20 has become inclined, the transfer belt 10 is moved in the width direction of the belt in accordance with the amount of inclination. Accordingly, the angle of inclination of the meandering correction roller 20 is changed by means of controlling the position of the eccentric cam 27 by means of the meandering correction motor 22, whereby meandering of the transfer belt 10 can be corrected.

Belt Position Detection Mechanism 40

Figure 1:
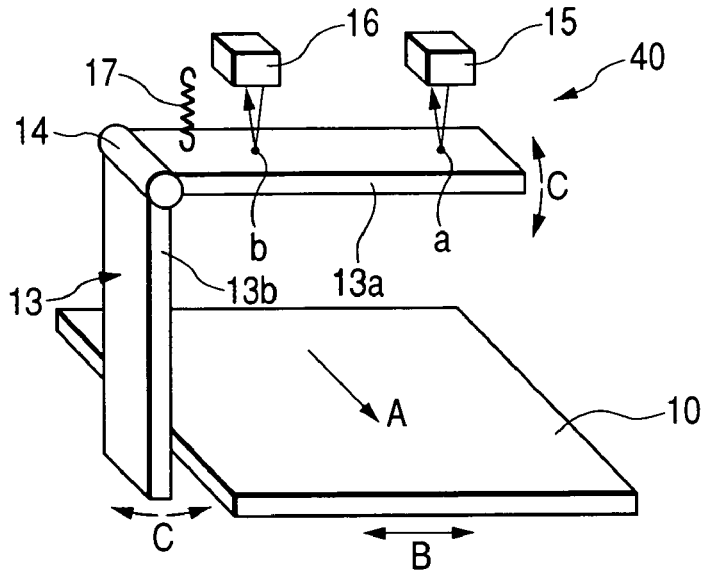
FIG. 1 is a diagrammatic view of a belt position detection mechanism provided in a belt conveyor according to a first embodiment of the present invention.

The belt position detection mechanism 40 for use with the belt conveyor of the present embodiment will now be described with reference to FIG. 1. The mechanism 40 for detecting the position of the transfer belt 10 in the width direction includes the L-shaped contact 13, a displacement sensor 15 constituting a first belt position detection unit, and a displacement sensor 16 constituting a second belt position detection unit.

The contact 13 is formed from the members 13*a* and 13*b*. The contact 13 is supported so as to be rotatable around a support shaft 14 in the direction of arrow C. One member 13*a* constituting the contact 13 is provided with a spring 17, and the other member 13*b* keeps in contact with the side edge of the transfer belt 10 at all times by means of tensile force of the spring 17.

The two displacement sensors 15 and 16 are provided in close to the member 13*a* of the contact 13 along the length direction thereof. Detailed descriptions of the displacement sensors 15 and 16 are omitted. For instance, each of the displacement sensors includes a light-emitting section and a light-receiving section. The light emitted by the light-emitting section is reflected from the object of measurement, so that the position of the reflected light received by the light-receiving section and the distance between the displacement sensors 15, 16 and the object of measurement can be determined on the basis of the displacement of the reference position.

The interval between the displacement sensors 15, 16 and the member 13*a* is set to a predetermined length, e.g., 6.5 mm. When the contact 13 rotates around the support shaft 14 to change the distance between the displacement sensors 15, 16 and the member 13*a*, an electrical signal corresponding to the change is obtained.

Figure 5:
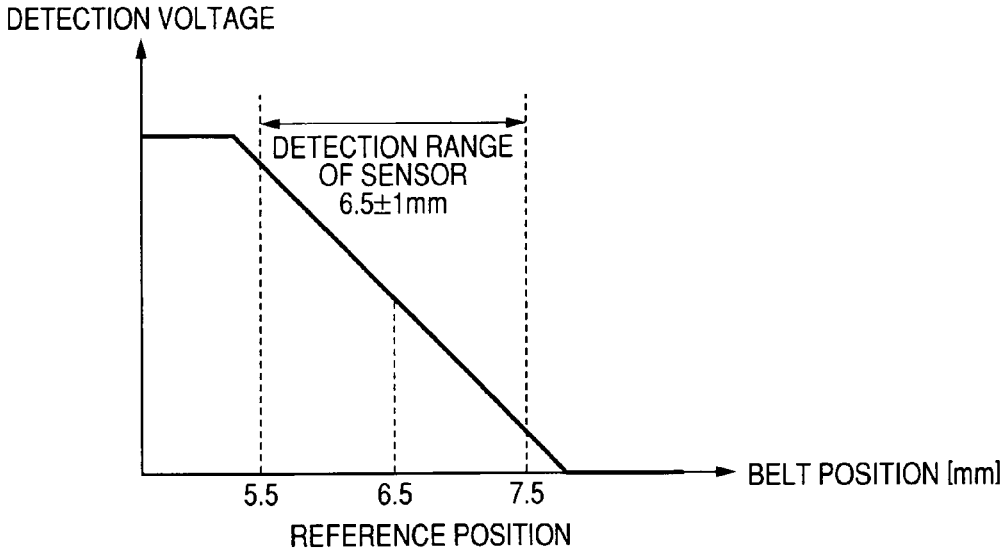
FIG. 5 is a characteristic chart of a belt position displacement sensor for use in the belt conveyor according to the embodiments of the present invention.

FIG. 5 shows an example characteristic of the displacement sensors 15 and 16. The horizontal axis represents the position of the belt (mm), and the vertical axis represents an output voltage (V). The detection range of the displacement detection sensor is 6.5 mm±1 mm, namely, a range of 2 mm, from 5.5 mm to 7.5 mm. The accuracy of detection assumes 10 μm.

In the present embodiment, a distance from the support shaft 14 of the contact 13 to a point where the transfer belt 10 contacts the member 13*b* is taken as Y. A distance from the support shaft 14 to a point of measurement where the displacement sensor 15 detects the member 13*a* (hereinafter described as a "measurement point a") is taken as X1. A distance from the support shaft 14 to a point of measurement (hereinafter described as a "measurement point b") where the displacement sensor 16 detects the member 13*a* is taken as X2. In this case, the arrangement is made in proportion of Y:X1:X2=5:5:1.

By means of such an arrangement, when the transfer belt 10 moves, e.g. by 1 mm, in the width direction, X1=1 mm, and X2=0.2 mm are obtained. The displacement sensors 15, 16 are arranged such that the medians of the respective detection ranges coincide with each other.

Accordingly, when the respective displacement sensors 15 and 16 exhibit the characteristics shown in FIG. 5, the range of displacement of the transfer belt 10 that can be detected by the displacement sensor 15 is 2 mm, whereas the range of displacement of the transfer belt 10 that can be detected by the displacement sensor 16 is 10 mm. Accuracy of the displacement sensor 15 in detecting the distance of displacement of the transfer belt 10 is 10 μm. In contrast, accuracy of the displacement sensor 16 in detecting the amount of displacement of the transfer belt 10 is 50 μm.

According to the belt conveyor of the present embodiment, meandering of the transfer belt 10 can be detected by the two displacement sensors 15, 16 with a detection range of 2 mm and detection accuracy of 10 μm and with a detection range of 10 mm and detection accuracy of 50 μm, as well.

These two detection signals are input to the meandering correction control section 30 shown in FIG. 3. From these two detection signals, the meandering correction control section 30 can ascertain the edge position of the transfer belt 10 in the width direction. Therefore, the meandering correction motor 22 is rotated according to the edge position, to thus perform control operation in such a way as to converge the edge position of the transfer belt 10 to the center of the respective detection ranges of the displacement sensors 15, 16.

Meandering Correction Control Section 30

Figure 8A:
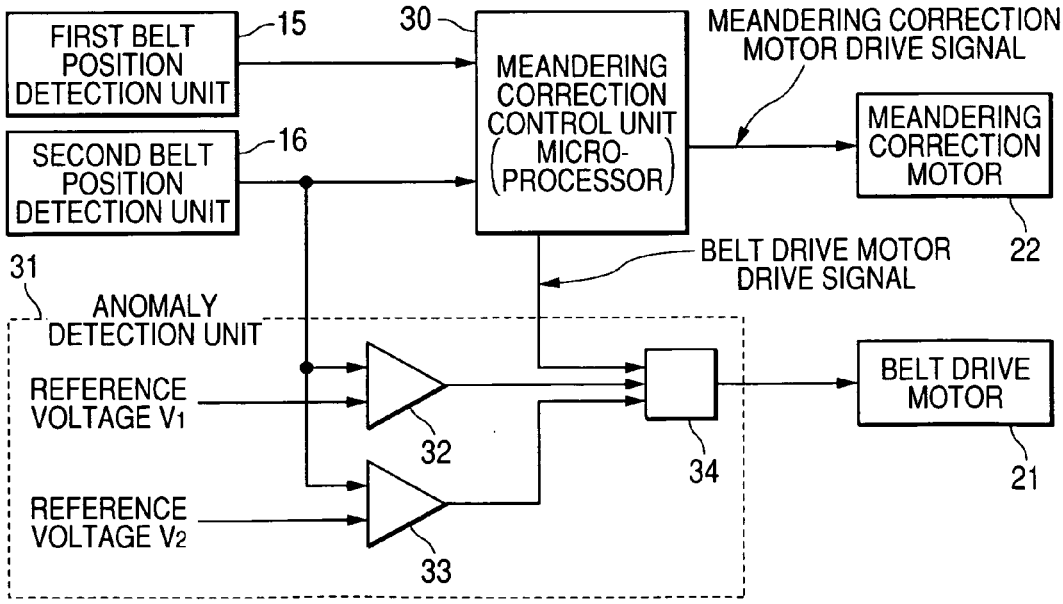
FIG. 8A is a block diagram of a control section in the belt conveyor according to the first embodiment of the present invention.

The meandering correction control section 30 will now be described with reference to FIGS. 8A and 8B. The meandering correction control section 30 includes a microprocessor. As mentioned previously, the detection signals from the displacement sensors 15, 16 constituting the first and second belt position detection units are input to the meandering correction control section 30, and the meandering correction control section 30 outputs a motor drive signal to the meandering correction motor 22.

Figure 8B:
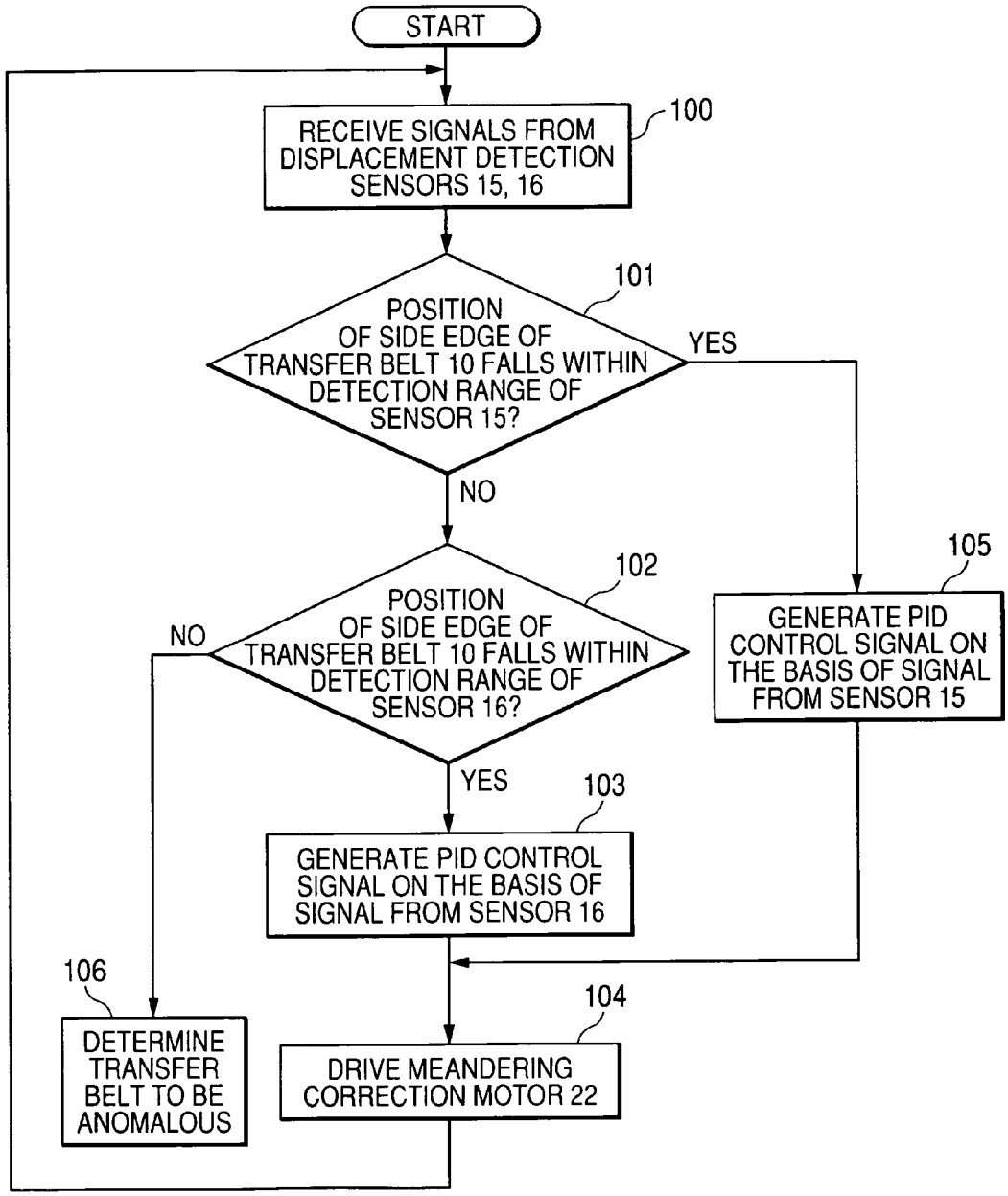
FIG. 8B is a flowchart showing the flow of control operation of the control section in the belt conveyor according to the first embodiment of the present invention.

The microprocessor 30 controls the meandering correction motor 22 in accordance with, e.g., a flowchart such as that shown in FIG. 8B. First, in step 100, the microprocessor 30 receives the detection signals from the displacement sensors 15 and 16, to compute the position of the side edge of the transfer belt 10. Instep 101, the microprocessor 30 determines whether or not the computed side edge falls within the detection range of the displacement detection sensor 15.

Figure 7:
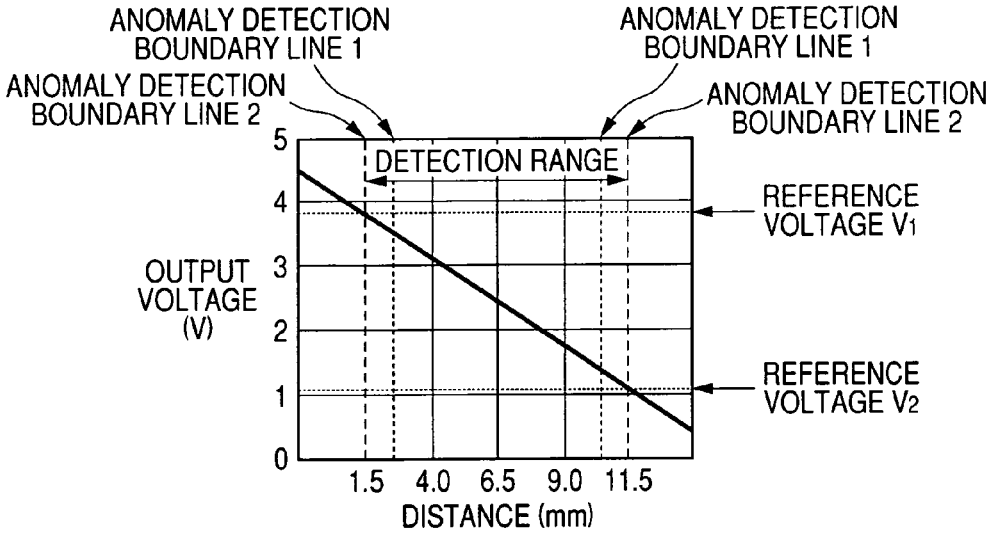
FIG. 7 is a characteristic chart of second belt position detection means in the belt conveyor according to the embodiments of the present invention.

As shown in FIG. 5, the detection range of the displacement sensor 15 spreads to an extent of ±1 mm with reference to 6.5 mm; namely, to an extent of 2 mm (this range will be hereinafter called a "first detection range"). Further, as shown in FIG. 7, the detection range of the displacement sensor 16 spreads to an extent of ±5 mm with reference to 6.5 mm; namely, an extent of 10 mm (this range will be hereinafter called a "second detection range").

When the position of the edge falls within the first detection range (2 mm) as a result of a determination rendered in step 101, a drive signal for the meandering correction motor 22 is generated from the signal from the displacement sensor 15. The method for generating the drive signal is known, and a drive signal is generated by, e.g., proportional operation, proportional operation+integral operation, or proportional operation+integral operation.

In the meantime, when the determination rendered in step 101 is NO, namely, when the position of the side edge of the transfer belt 10 is out of the first detection range, processing proceeds to step 102, where a determination is made as to whether or not the position of the side edge falls within the second detection range (10 mm). When NO is determined in step 102, an anomaly is determined to arise in the driving of the transfer belt 10 (step 106).

When YES is determined in step 102, namely, when the position of the edge is determined to fall within the second detection range (10 mm), for instance, (proportional operation+integral operation+differential operation) operations are executed in accordance with the signal from the displacement sensor 16, thereby driving the meandering correction motor 22. Consequently, the meandering gradually become smaller, and a determination is again rendered in step 101, whereby the amount of meandering falls within the first detection range (2 mm). Processing proceeds to step 105, where the meandering are controlled so as to become further smaller.

An example control operation performed by the meandering correction control section 30 will now be described with reference to FIG. 6. In this drawing, the position of the transfer belt 10 acquired when the position of the side edge of the transfer belt 10 is situated in the center of the respective displacement sensors 15, 16 is taken as 0 mm, a distance over which the transfer belt 10 meanders rightward in relation to the conveying direction is taken to be positive; and a distance over which the transfer belt 10 has meandered leftward in relation to the conveying direction is taken to be negative.

Figure 6:
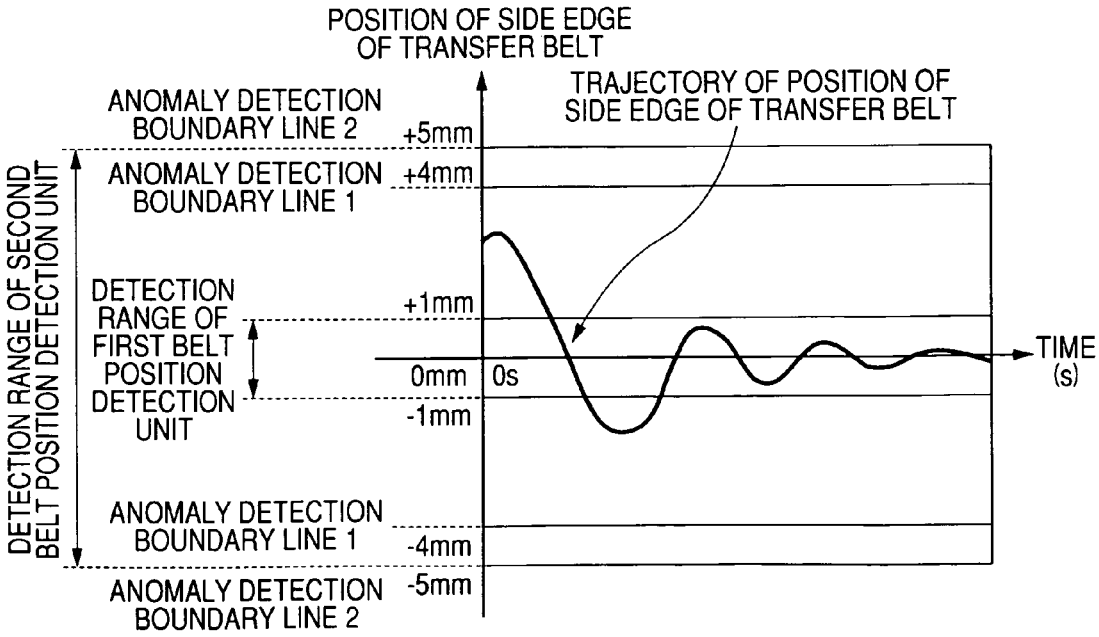
FIG. 6 is a descriptive view pertaining to operation of the belt conveyor according to the embodiments of the present invention.

In FIG. 6, the position of the transfer belt 10 achieved at time t=0 is about +3 mm and falls out of the first detection range (an extent of ±1 mm from the center position). Hence, the microprocessor proceeds to processing pertains to steps 100, 101, 102, 103 in FIG. 8A and performs processing pertaining to step 103. Consequently, the meandering correction motor 22 is driven in such a way that the position of the transfer belt 10 moves toward the negative direction. The position of the transfer belt 10 gradually moves toward the center but keeps moving, without converging on the center, toward the negative direction beyond the center. Moreover, the meandering correction control section 30 controls the position of the transfer belt 10 so as to move toward the positive direction. When the position of the transfer belt 10 has fell into the first detection range, the microprocessor executes processing pertaining to step 105, and the position of the transfer belt 10 gradually converges on the center.

As mentioned above, according to the first embodiment of the present invention, the two displacement sensors 15, 16 are selectively used according to the position of the side edge of the transfer belt 10, whereby meandering can be corrected over the wide range of the transfer belt 10 with respect to the width direction. When the amount of meandering become smaller than the predetermined value, correction of meandering can be corrected with high accuracy.

Anomaly Detection Section 31

The anomaly detection section 31 in FIG. 8A will now be described. The anomaly detection section 31 includes first and second comparators 32 and 33 for comparing the signal from the displacement sensor 16, constituting the second belt position detection unit, with first and second reference voltages $V_1$ and $V_2$; and a drive condition discriminator 34 that receives signals output from the respective comparators 32, 33 and the belt drive motor drive signal from the meandering correction control section 30.

As shown in, e.g., FIG. 7, the first reference voltage $V_1$ is set to about 3.8V, and the second reference voltage $V_2$ is set to about 1.1V. When the output from the displacement detection sensor 16 exceeds $V_1$, the first comparator 32 generates a signal. When the output from the displacement detection sensor 16 becomes smaller than $V_2$, the second comparator 33 generates a signal.

Upon receipt of an application of a signal from any one of the first and second comparators 32, 33, the drive condition discriminator 34 generates a control signal for stopping driving operation of the belt drive motor 21. Specifically, when the amount of meandering of the transfer belt 10 exceeds the detection range of the displacement sensor 16, or an extent of ±5 mm with reference to 6.5 mm, namely, when the amount of meandering of the transfer belt 10 exceeds an anomaly detection boundary line 2 shown in FIG. 7, the driving of the transfer belt 10 is determined to be anomalous, and the belt drive motor 21 is deactivated, to thus stop the driving of the transfer belt 10.

Aside from the above situation, for instance, when the output from the displacement sensor 16 exceeds a value of about 3.5V or become smaller than a value of about 1.5V, namely, when the output from the displacement sensor 16 exceeds an anomaly detection boundary line 1 shown in FIG. 7, the microprocessor deactivates the belt drive motor drive signal. Even at this time, the discriminator 34 outputs a command signal for deactivating the belt drive motor 21. In the present embodiment, when the output from the displacement sensor 16 has exceeds the anomaly detection boundary lines 1 and 2, a signal for deactivating the belt drive motor can be output, respectively. For example, even in a case where the microprocessor sometimes performs an operation failure, when great meandering arises in the transfer belt 10, the driving of the transfer belt 10 is stopped without fail, and fracture of the edge can be prevented reliably.

Although the above descriptions provides a case where two displacement sensors are used as belt position detection units, the detection range and accuracy of detection may also be changed in multi-stages by use of a plurality of sensors of two or more sensors.

Second Embodiment

Figure 10:
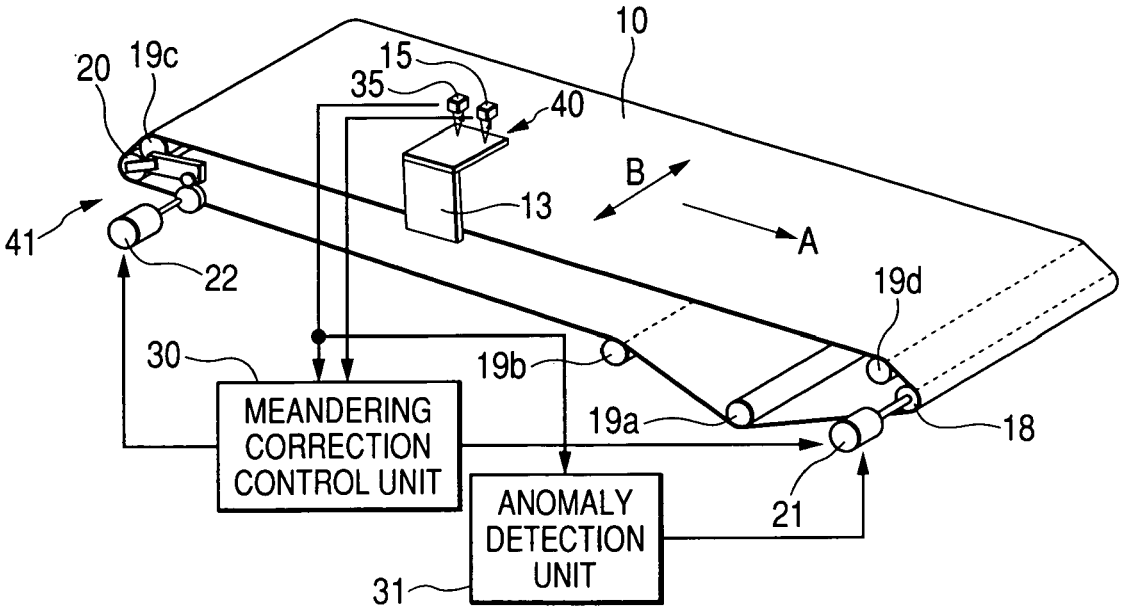
FIG. 10 is a diagrammatic view showing the belt conveyor according to the second embodiment of the present invention.
Figure 11:
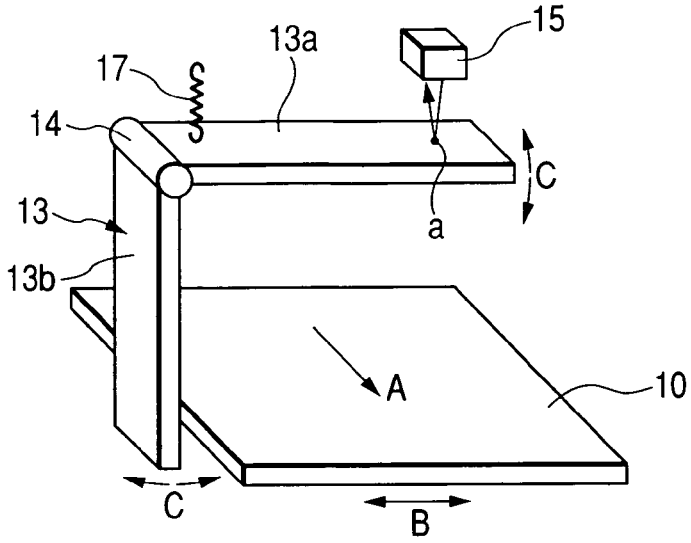
FIG. 11 is a descriptive view of a belt position detection mechanism provided in a belt conveyor according to a third embodiment of the present invention.

FIG. 10 is a diagrammatic view showing a belt conveyor according to a second embodiment of the present invention. In the drawing, the belt conveyor is identical with the configuration shown in FIG. 3 except the configuration of the belt position detection mechanism section 40. Explanations about the elements other than the mechanism section 40 are omitted.

In the first embodiment, two displacement detection sensors are used as the belt position detection unit. One of the two sensors is comparatively, highly accurate because of its detection accuracy of 10 μm, and hence expensive. In the present embodiment, a displacement sensor 35, inferior to detection accuracy to the displacement sensor 16 and having a detection range which is wider than that of the displacement sensor 16 is used. Hence, the belt position detection mechanism 40 will be described hereunder with reference to FIG. 9.

Figure 9:
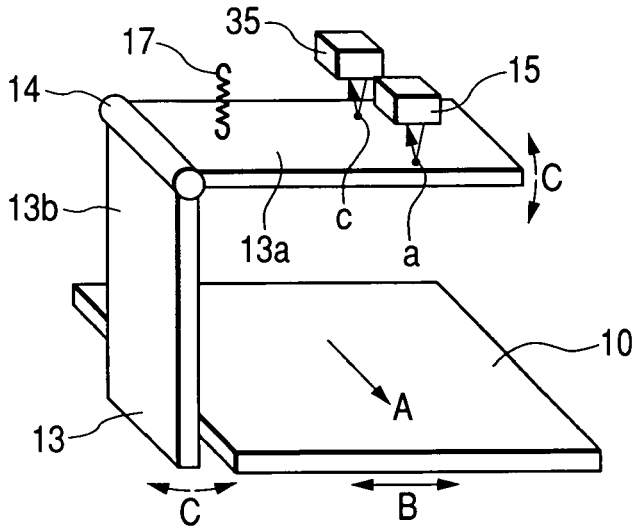
FIG. 9 is a diagrammatic view of a belt position detection mechanism provided in a belt conveyor according to a second embodiment of the present invention.

In FIG. 9, the contact 13 is formed into an L-shaped form from the members 13*a*, 13*b* and supported so as to be rotatable around the support shaft 14. In the case of the embodiment shown in FIG. 1, the two displacement sensors 15, 16 are positioned opposite the member 13*a* and at different positions with respect to the width direction of the belt 10. However, in the present embodiment, the two displacement sensors 15 and 35 are displaced at the single position with respect to the width direction of the belt 10 but at different positions with respect to the conveying direction of the belt 10. Specifically, the points where the displacement sensors 15, 35 measure the contact are taken as "a" and "c," the displacement sensors 15, 35 are arranged such that the distance between the support shaft 14 and "a" and the distance between the support shaft 14 and "c" become equal to each other.

In the meantime, when the detection range of the displacement sensor 15 is taken as, e.g., 6.5 mm±1 mm, the detection range of the displacement sensor 35 is taken as, e.g., 6.5 mm±5 mm. Thus, the sensor whose detection range is different from that of the displacement sensor 15 is used. The detection accuracy of the sensor used as the displacement sensor 35 is lower than that of the displacement sensor 15.

In the second embodiment, the detection range of the displacement sensor 35 becomes wider than that of the displacement sensor 15. Hence, the anomaly detection boundary 1 conforming to the detection range of the displacement sensor 35 is defined. A reference voltage input to the comparators 32, 33 is set such that the detection range limit of the displacement sensor 35 becomes the anomaly detection boundary line 2, the meandering correction control operation performed by the meandering correction control unit 30 can be performed in the same manner as in the first embodiment.

When a standard distance between the displacement sensor 35 and the object of measurement is different from that of the displacement sensor 15, the meandering correction control performed by the meandering correction control unit 30 can be performed in the same manner as in the first embodiment by means of applying contrivance to the arrangement of the displacement sensor 35.

According to the second embodiment of the present invention, the two displacement sensors 15, 35 are selectively used according to the position of the side edge of the transfer belt 10, whereby meandering can be corrected over a wide range of the transfer belt 10 with respect to the width direction. There are advantages of being able to perform meandering correction control with high accuracy when the amount of meandering becomes smaller than the predetermined value and to use an inexpensive sensor having a comparatively-low degree of detection accuracy as the displacement sensor 35.

Third Embodiment

Figure 12:
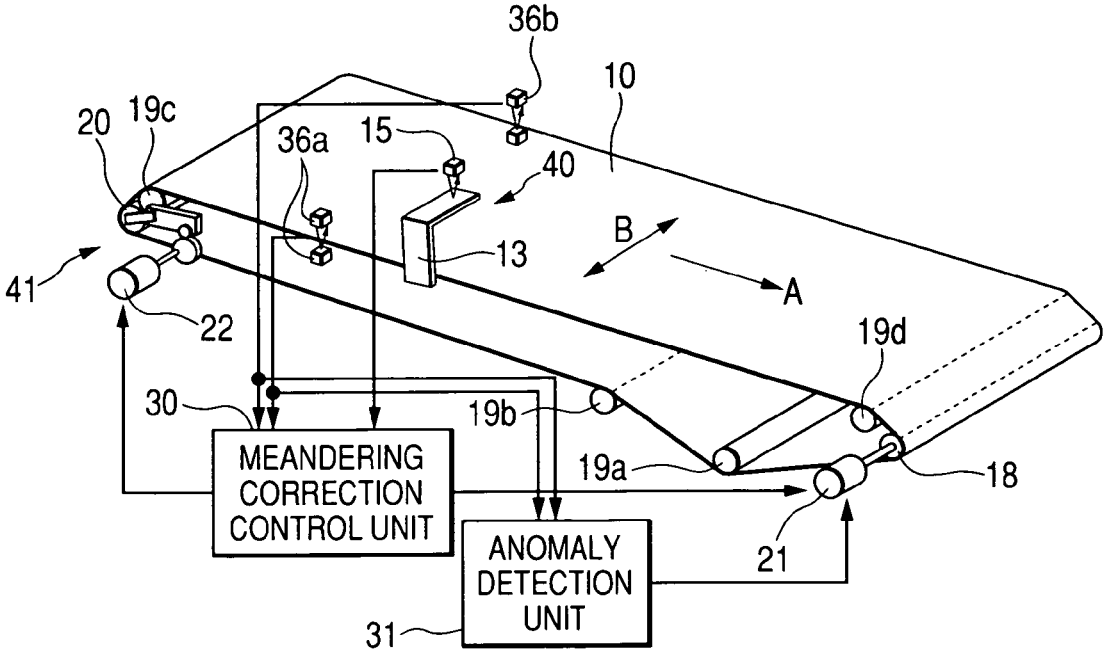
FIG. 12 is a diagrammatic view showing the belt conveyor according to the third embodiment of the present invention.

FIG. 12 is a diagrammatic view showing a belt conveyor according to a third embodiment of the present invention. The present embodiment is also configured analogously to the embodiment shown in FIG. 3 except the belt position detection mechanism 40.

Figure 16:
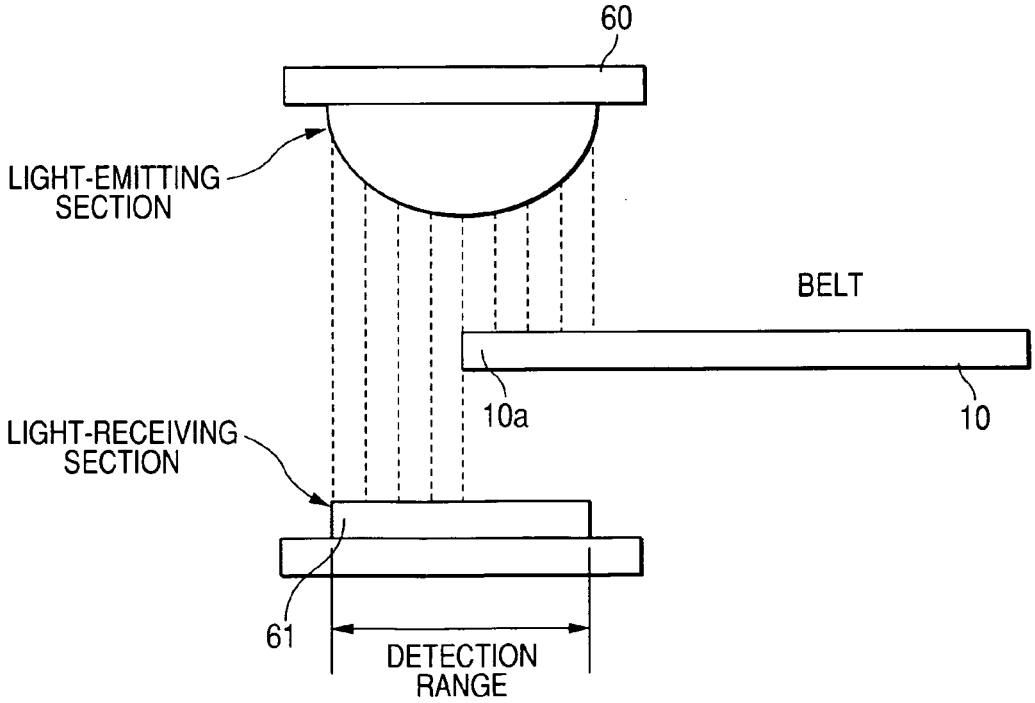
FIG. 16 is a descriptive view showing an example edge sensor for a transfer belt.

The belt position detection mechanism 40 of the present embodiment has the displacement sensor 15 and edge sensors 36*a*, 36*b* disposed on both sides of the belt 10 in the width direction. The displacement sensor 15 is provided at a position opposite the member 13*a* of the L-shaped contact 13. As shown in FIG. 16, each of the edge sensors 36*a*, 36*b* may be configured to have a light-emitting section 60 and a light-receiving section 61. The essential requirement for the edge sensor is a mere sensor or detection mechanism, which can detect presence or absence of the side edge of a belt.

In the present embodiment, the displacement sensor 15 is arranged in the same manner as in the first embodiment in order to detect the position of the side edge of the transfer belt 10 with high accuracy. The edge sensors 36*a* and 36*b* are provided on both sides with respect to the conveying direction of the transfer belt 10. The edge sensors 36*a*, 36*b* are placed in positions which detect the location corresponding to the anomaly detection boundary line 2 described in connection with the first and second embodiments.

When the position of the side edge of the transfer belt 10 is out of the detection range of the displacement sensor 15, the accurate position of the transfer belt 10 cannot be ascertained by means of the meandering correction control shown in FIG. 3. Since the transfer belt 10 can be ascertained to have meandered rightward or leftward on the basis of the voltage output from the displacement sensor 15, the meandering correction control unit 30 performs meandering correction control operation so as to cause the transfer belt 10 to converge on the center by means of appropriately rotating the meandering correction motor 22. When the position of the side edge of the transfer belt 10 has fell within the detection range of the displacement sensor 15, meandering correction control is performed in accordance with the voltage output from the displacement sensor 15.

Even when meandering correction control operation has been performed in a case where the position of the side edge of the transfer belt 10 falls out of the detection range of the displacement sensor 15, the transfer belt 10 is unascertained if it has converged on the center until the position of the side edge of the transfer belt 10 falls within the detection range of the displacement sensor 15. Accordingly, even when meandering correction control operation is performed in a case where the position of the side edge of the transfer belt 10 is out of the detection range of the displacement sensor 15, the driving of the transfer belt is determined to be analogous unless the position of the side edge of the transfer belt falls within the detection range of the displacement sensor 15 within a specified period of time, and the belt drive motor 21 is deactivated.

Figure 13A:
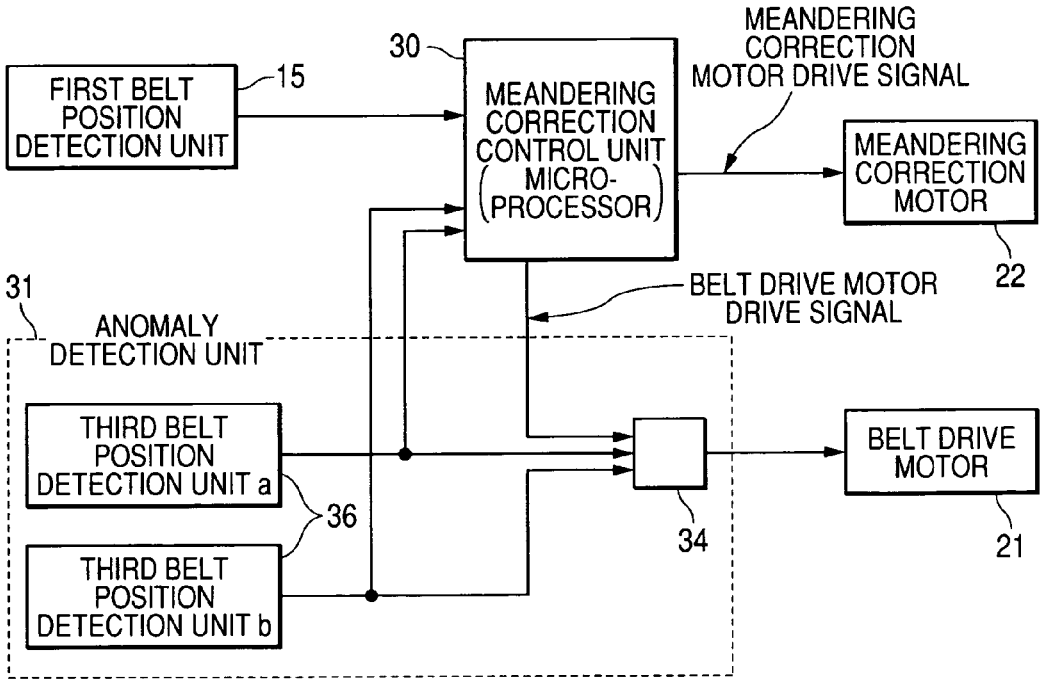
FIG. 13A is a block diagram of a control section in the belt conveyor according to the third embodiment of the present invention.

As shown in FIG. 13A, in relation to detection of an anomaly in the conveying position of the transfer belt 10 in the third embodiment, a circuit configuration is embodied in such a way that the drive condition discriminator 34 activates the belt drive motor 21 when the edge sensors 36*a* and 36*b* constituting the third belt position detection unit remain simultaneously deactivated; i.e., when the side edge of the transfer belt 10 is not detected. Therefore, when great meandering have arisen during the course of driving of the transfer belt 10 and the edge sensor 36*a* or 36*b* become deactivated, the drive signal for the belt drive motor 21 is disconnected, and the belt drive motor 21 is deactivated.

Figure 13B:
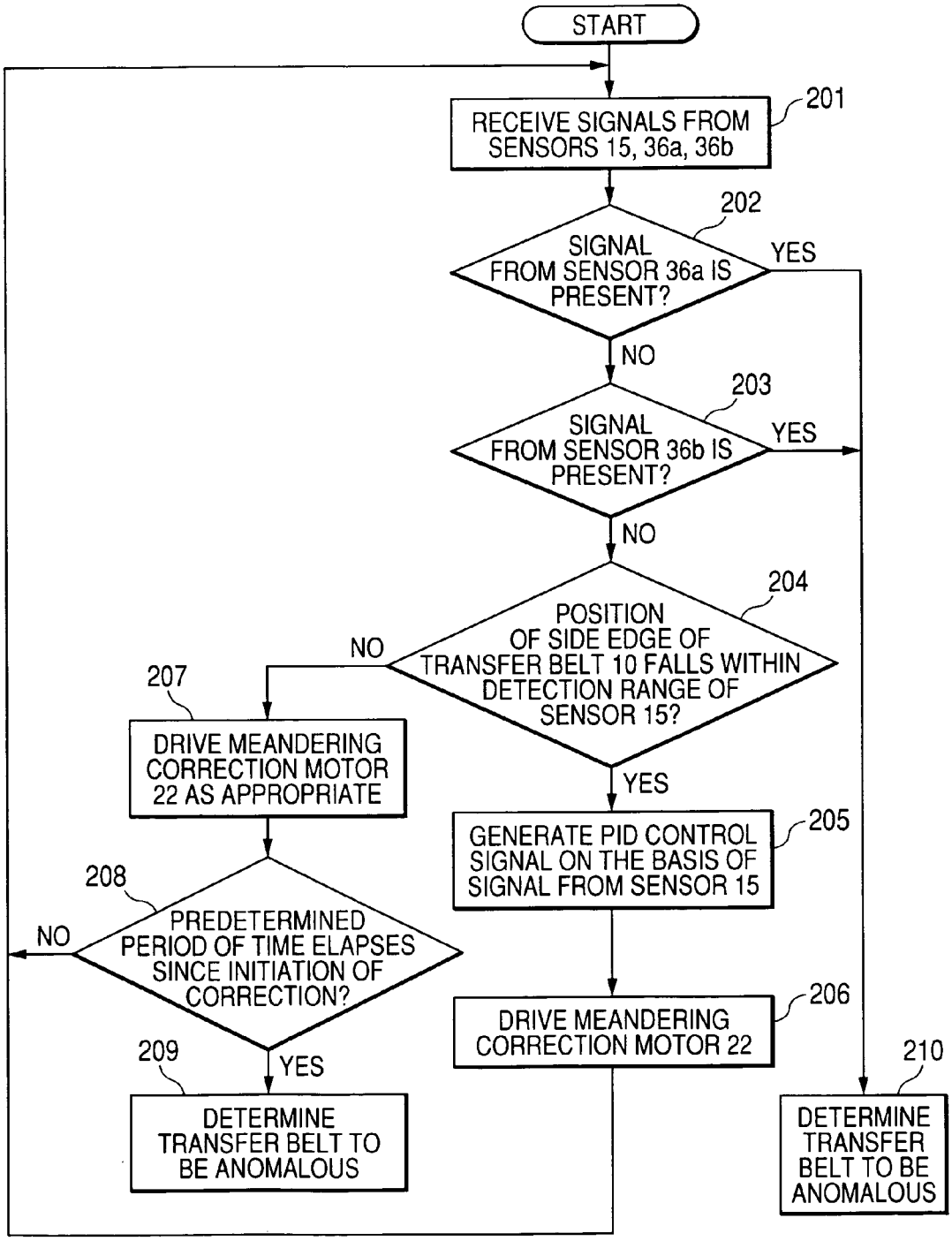
FIG. 13B is a flowchart showing the flow of control operation of the control section in the belt conveyor according to the third embodiment of the present invention.
Figure 14A:
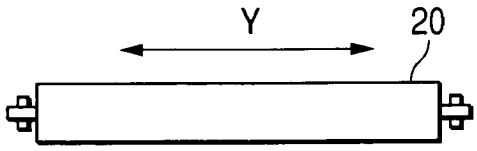
FIGS. 14A to 14C are descriptive views of a related-art belt conveyor.
Figure 14B:
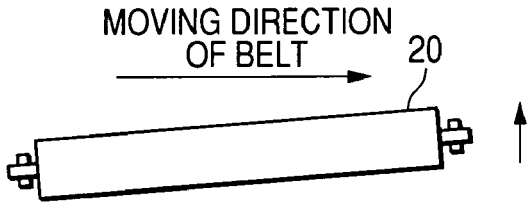
Figure 14C:
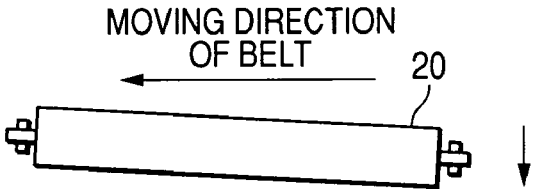
Figure 15:
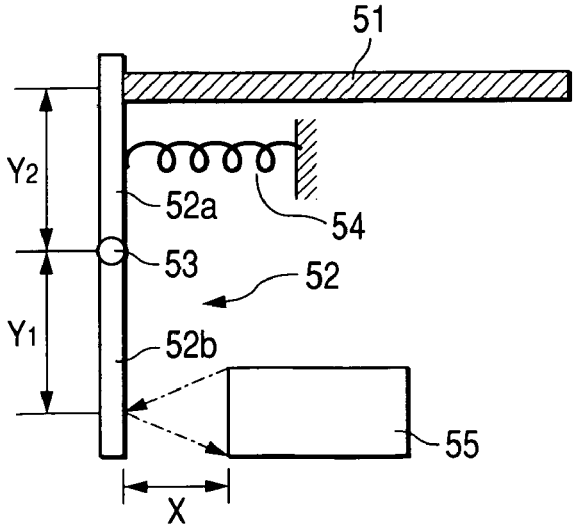
FIG. 15 is a descriptive view of a related-art belt position detection mechanism.

A control flow of the meandering correction control section 30 of the present embodiment will be described with reference to FIG. 13B.

In step 201, the meandering correction control section receives any of the signals from the displacement sensor 15 and the edge sensors 36*a*, 36*b*. In step 202, a determination is made as to whether or not the signal from the edge sensor 36*a* is present. When the signal is determined to be present, the meandering is determined to be greater than the predetermined level and anomalous (step 210). Next, when the signal from the sensor 36*a* is absent, processing proceeds to step 203, where a determination is made as to whether or not the signal from the other edge sensor 36*b* is present. When the signal is determined to be present, the meandering is determined to be anomalous in the same manner as mentioned above.

When both the signals from the edge sensors 36*a* and 36*b* are not active, namely, when the side edge of the transfer belt 10 is not detected, the meandering of the transfer belt 10 in the width direction are determined to fall within the predetermined range, and processing proceeds to subsequent step S204.

In step 204, a determination is made as to whether or not the position of the side edge of the transfer belt 10 fall within the detection range of the displacement sensor 15. When YES is selected, a PID control signal is generated in step 205 in accordance with the signal from the displacement sensor 15. In accordance with the control signal, the meandering correction motor 22 is driven in step 206.

When NO is selected by means of the determination rendered in step S204; namely, when the position of the side edge of the transfer belt 10 does not fall within the detection range of the displacement sensor 15, the transfer belt 10 is understood to have meandered rightward or leftward on the basis of the voltage output from the displacement sensor 15. In step 207, the meandering correction motor 22 is driven, as appropriate, in a direction where the meandering is corrected. Moreover, in step 208, a determination is made as to whether or not a predetermined period of time has elapsed since initiation of correction. When the predetermined period of time has not elapsed, processing returns to step 201, where the same operations are performed iteratively. When the position of the side edge of the transfer belt 10 fails to fall within the detection range of the displacement sensor 15 within the predetermined period of time, the driving of the transfer belt is determined to be anomalous (S209).

According to the third embodiment, when great meandering arises in the transfer belt 10, the driving of the transfer belt 10 are stopped without fail, to thus prevent fracture of the side edge of the transfer belt 10.

The entire disclosure of Japanese Patent Application No. 2005-170583 filed on Jun. 10, 2005 including specification, claims, drawings and abstract is incorporated herein be reference in its entirety.

What is claimed is:

1. A belt conveyor, comprising:

an endless belt that is looped over a plurality of rollers, the plurality of rollers including a drive roller and a meandering correction roller;

a drive unit that rotates the drive roller to drive the endless belt;

a meandering correction unit that adjusts an inclination of the meandering correction roller to correct meandering of the endless belt in a width direction thereof;

a plurality of position detection units that detects positions of the endless belt in the width direction thereof and output detection signals; and a meandering correction control unit that uses the detection signals from the plurality of detection units to control the meandering correction unit, wherein the plurality of position detection units includes first and second position detection units that continuously detect the positions of the endless belt in the width direction, wherein the first and second position detection units are placed at different positions with respect to the width direction of the endless belt from each other, wherein the meandering correction control unit selectively uses the detection signal from one of the first and second position detection units to control the meandering correction unit, wherein the first and second position detection units have equal detection ranges, and further comprising a control unit that stops a rotation of the drive roller when the detection signal from one of the first and second position detection units falls outside a predetermined range.

2. The belt conveyor according to claim 1, wherein each of the first and second position detection units includes:

a displacement member that displaces in response to displacement of the endless belt in the width direction thereof; and a sensor that converts an amount of the displacement of the displacement member into an electrical signal, wherein the amount of the displacement of the displacement member included in the first position detection unit and the amount of the displacement of the displacement member included in the second position detection unit are different from each other.

3. The belt conveyor according to claim 1, wherein the first and second position detection units each have a different position detection accuracy from the other.

4. A belt conveyor comprising:

an endless belt that is looped over a plurality of rollers, the plurality of rollers including a drive roller and a meandering correction roller;

a drive unit that rotates the drive roller to drive the endless belt;

a meandering correction unit that adjusts an inclination of the meandering correction roller to correct meandering of the endless belt in a width direction thereof;

a plurality of position detection units that detects positions of the endless belt in the width direction thereof and outputs detection signals; and a meandering correction control unit that uses the detection signals from the plurality of detection units to control the meandering correction unit, wherein the plurality of position detection units includes first and second position detection units that continuously detect the positions of the endless belt in the width direction, wherein the first and second position detection units are placed at different positions with respect to the width direction of the endless belt from each other, wherein the meandering correction control unit selectively uses the detection signal from one of the first and second position detection units to control the meandering correction unit, wherein the first and second position detection units each have different detection ranges from each other, and further comprising a control unit that stops a rotation of the drive roller when the detection signal from one of the first and second position detection units falls outside a predetermined range.

5. The belt conveyor according to claim 4, wherein each of the first and second position detection units includes:

a displacement member that displaces in response to displacement of the endless belt in the width direction thereof; and a sensor that converts an amount of the displacement of the displacement member into an electrical signal, and wherein the amount of the displacement of the displacement member included in the first position detection unit and the amount of the displacement of the displacement member included in the second position detection unit are different from each other.

6. The belt conveyor according to claim 4, wherein the first and second position detection units each have different position detection accuracy from the other.

7. A belt conveyor, comprising:

an endless belt that is looped over a plurality of rollers, the plurality of rollers including a drive roller and a meandering correction roller;

a drive unit that rotates the drive roller to drive the endless belt;

a meandering correction unit that adjusts an inclination of the meandering correction roller to correct meandering of the endless belt in a width direction thereof;

a plurality of position detection units that detects positions of the endless belt in the width direction thereof and output detection signals; and a meandering correction control unit that uses the detection signals from the plurality of position detection units to control the meandering correction unit, wherein the plurality of position detection units includes first and second position detection units that continuously detect the positions of the endless belt in the width direction, wherein the first and second position detection units are placed at different positions with respect to a conveying direction of the endless belt from each other, wherein the first and second position detection units have equal detection ranges, and further comprising a control unit that stops a rotation of the drive roller when the detection signal from one of the first and second position detection units falls outside a predetermined range.

8. The belt conveyor according to claim 7, wherein each of the first and second position detection units includes:

a displacement member that displaces in response to displacement of the endless belt in the width direction thereof; and a sensor that converts an amount of the displacement of the displacement member into an electrical signal.

9. The belt conveyor according to claim 7, wherein the meandering correction control unit selectively uses the detection signal from one of the first and second position detection units to control the meandering correction unit.

10. The belt conveyor according to claim 7, wherein the first and second position detection units have different position detection accuracy from each other.

11. A belt conveyor, comprising:

an endless belt that is looped over a plurality of rollers, the plurality of rollers including a drive roller and a meandering correction roller;

a drive unit that rotates the drive roller to drive the endless belt;

a meandering correction unit that adjusts an inclination of the meandering correction roller to correct meandering of the endless belt in a width direction thereof;

a plurality of position detection units that detects positions of the endless belt in the width direction thereof and output detection signals; and a meandering correction control unit that uses the detection signals from the plurality of position detection units to control the meandering correction unit, wherein the plurality of position detection units includes first and second position detection units that continuously detect the positions of the endless belt in the width direction, wherein the first and second position detection units are placed at different positions with respect to a conveying direction of the endless belt from each other, wherein the first and second position detection units have different detection ranges from each other, and further comprising a control unit that stops a rotation of the drive roller when the detection signal from one of the first and second position detection units falls outside a predetermined range.

12. The belt conveyor according to claim 11, wherein each of the first and second position detection units includes:

a displacement member that displaces in response to displacement of the endless belt in the width direction thereof; and a sensor that converts an amount of the displacement of the displacement member into an electrical signal.

13. The belt conveyor according to claim 11, wherein the meandering correction control unit selectively uses the detection signal from one of the first and second position detection units to control the meandering correction unit.

14. The belt conveyor according to claim 11, wherein the first and second position detection units each have a different position detection accuracy from the other.

15. A belt conveyor, comprising:

an endless belt that is looped over a plurality of rollers, the plurality of rollers including a drive roller and a meandering correction roller;

a drive unit that rotates the drive roller to drive the endless belt;

a meandering correction unit that adjusts an inclination of the meandering correction roller to correct meandering of the endless belt in a width direction thereof;

a plurality of position detection units that detects positions of the endless belt in the width direction thereof and output detection signals; and a meandering correction control unit that selectively uses the detection signals from the position detection units to control the meandering correction unit, wherein the plurality of position detection units includes:

a first position detection unit that continuously detects the position of the endless belt in the width direction thereof;

a third position detection unit having sensors disposed on both sides of the endless belt that detects a presence/absence of the endless belt within a detection region of each of said sensors, and wherein the belt conveyor further comprises a control unit configured to stop the rotation of the drive roller when the third position detection unit detects the presence of the endless belt.

16. An image-forming apparatus, comprising:

the belt conveyor according to claim 1; and an image-forming unit that transfers a toner image onto the endless belt included in the belt conveyor.

17. An image-forming apparatus, comprising:

the belt conveyor according to claim 7; and an image-forming unit that transfers a toner image onto the endless belt included in the belt conveyor.

18. An image-forming apparatus, comprising:

the belt conveyor according to claim 11; and an image-forming unit that transfers a toner image onto the endless belt included in the belt conveyor.

19. An image-forming apparatus, comprising:

the belt conveyor according to claim 15; and an image-forming unit that transfers a toner image onto the endless belt included in the belt conveyor.

20. A color image-forming apparatus, comprising:

a belt conveyor that drives an endless transfer belt in a conveying direction; and a plurality of image-forming units that are disposed along the conveying direction and transfers toner images of the plurality of image-forming units onto the endless transfer belt in an overlapping manner, wherein the belt conveyor includes:

a drive unit that rotates a drive roller to drive the endless transfer belt;

a meandering correction unit that adjusts an inclination of a meandering correction roller to correct meandering of the endless transfer belt in a width direction thereof a plurality of position detection units that detects positions of the endless transfer belt in the width direction thereof and output detection signals; and a meandering correction control unit that uses the detection signals from the plurality of position detection units to control the meandering correction unit, wherein the plurality of position detection units includes first and second position detection units that continuously detect the positions of the endless transfer belt in the width direction, wherein the first and second position detection units are placed at different positions with respect to the width direction of the endless transfer belt from each other, wherein the meandering correction control unit selectively uses the detection signal from one of the first and second position detection units to control the meandering correction unit, wherein the first and second position detection units have equal detection ranges, and further comprising a control unit that stops a rotation of the drive roller when the detection signal from one of the first and second position detection units falls outside a predetermined range.

21. A color image-forming apparatus, comprising:

a belt conveyor that drives an endless transfer belt in a conveying direction; and a plurality of image-forming units that are disposed along the conveying direction and transfers toner images of the plurality of image-forming units onto the endless transfer belt in an overlapping manner, wherein the belt conveyor includes:

a drive unit that rotates a drive roller to drive the endless transfer belt;

a meandering correction unit that adjusts an inclination of a meandering correction roller to correct meandering of the endless transfer belt in a width direction thereof a plurality of position detection units that detects positions of the endless transfer belt in the width direction thereof and output detection signals; and a meandering correction control unit that uses the detection signals from the plurality of position detection units to control the meandering correction unit, wherein the plurality of position detection units includes first and second position detection units that continuously detect the positions of the endless transfer belt in the width direction, wherein the first and second position detection units are placed at different positions with respect to the conveying direction of the endless transfer belt from each other, wherein the first and second position detection units have equal detection ranges, and further comprising a control unit that stops a rotation of the drive roller when the detection signal from one of the first and second position detection units falls outside a predetermined range.

22. A color image-farming apparatus, comprising:

a belt conveyor that drives an endless transfer belt in a conveying direction; and a plurality of image-forming units that are disposed along the conveying direction and transfers toner images of the plurality of image-forming units onto the endless transfer belt in an overlapping manner, wherein the belt conveyor includes:

a drive unit that rotates a drive roller to drive the endless transfer belt;

a meandering correction control unit that adjusts an inclination of a meandering correction roller to correct meandering of the endless transfer belt in a width direction thereof;

a plurality of position detection units that detects positions of the endless transfer belt in the width direction thereof and outputs detection signals; and a meandering correction control unit that uses the detection signals from the plurality of position detection units to control the meandering correction unit, wherein the plurality of position detection units includes first and second position detection units that continuously detect the positions of the endless transfer belt in the width direction, wherein the first and second position detection units are placed at different positions with respect to the conveying direction of the endless transfer belt from each other, wherein the first and second position detection units have different detection ranges from each other, and further comprising a control unit that stops a rotation of the drive roller when the detection signal from one of the first and second position detection units falls outside a predetermined range.

23. A color image-forming apparatus, comprising:

a belt conveyor that drives an endless transfer belt in a conveying direction; and a plurality of image-forming units that are disposed along the conveying direction and transfers toner images of the plurality of image-forming units onto the endless transfer belt in an overlapping manner, wherein the belt conveyor includes:

a drive unit that rotates a drive roller to drive the endless transfer belt;

a meandering correction unit that adjusts an inclination of a meandering correction roller to correct meandering of the endless transfer belt in a width direction thereof;

a plurality of position detection units that detects a position of the endless transfer belt in a width direction perpendicular to the conveying direction and outputs detection signals; and a meandering correction control unit that selectively uses the detection signals from the plurality of position detection units to control the meandering correction unit, wherein the plurality of the position detection units includes:

a first position detection unit that continuously detects the position of the endless transfer belt in the width direction thereof; and a third position detection unit having sensors disposed on both sides of the endless belt that detects a presence/absence of the endless transfer belt within a detection region of each of said sensors, the belt conveyor further including a control unit configured to stop the rotation of the drive roller when the third position detection unit detects the presence of the endless transfer belt.

24. An image-forming apparatus, comprising:

the belt conveyor according to claim 4; and an image-forming unit that transfers a toner image onto the endless belt included in the belt conveyor.

25. A color image-forming apparatus, comprising:

a belt conveyor that drives an endless transfer belt in a conveying direction; and a plurality of image-forming units that are disposed along the conveying direction and transfer toner images of the plurality of image-forming units onto the endless transfer belt in an overlapping manner, wherein the belt conveyor includes:

a drive unit that rotates a drive roller to drive the endless transfer belt;

a meandering correction unit that adjusts an inclination of a meandering correction roller to correct meandering of the endless transfer belt in a width direction thereof;

a plurality of position detection units that detects positions of the endless transfer belt in the width direction thereof and outputs detection signals; and a meandering correction control unit that selectively uses the detection signals from the plurality of position detection units to control the meandering correction unit, wherein the plurality of position detection units includes first and second position detection units that continuously detect the positions of the endless transfer belt in the width direction, wherein the first and second position detection units are placed at different positions with respect to the conveying direction of the endless transfer belt from each other, wherein the meandering correction control unit selectively uses the detection signal from one of the first and second position detection units to control the meandering correction unit, wherein the first and second position detection units have equal detection ranges, and further comprising a control unit that stops a rotation of the drive roller when the detection signal from one of the first and second position detection units falls outside a predetermined range.

* * * * *